United States Patent [19]

Scott

[11] Patent Number: 4,714,170

[45] Date of Patent: Dec. 22, 1987

[54] LARGE STORAGE TANK STRUCTURES

[75] Inventor: Leslie D. Scott, Atascadero, Calif.

[73] Assignee: Trusco Tank Inc., San Luis Obispo, Calif.

[21] Appl. No.: 853,132

[22] Filed: Apr. 17, 1986

[51] Int. Cl.[4] ..... B65D 6/32; B65D 6/34

[52] U.S. Cl. ..... 220/5 A; 220/1 B; 220/DIG. 29

[58] Field of Search ..... 220/1 B, 5 A, DIG. 29

[56] References Cited

U.S. PATENT DOCUMENTS

| | | | |
|---|---|---|---|
| 1,743,459 | 7/1930 | Icjelastad | 220/1 B |
| 1,798,190 | 3/1931 | Carter | 220/1 B |
| 1,965,736 | 7/1934 | Dillman | 220/1 B |
| 2,012,964 | 9/1935 | Hoiton | 220/1 B |
| 2,073,358 | 3/1937 | Williamson | 220/1 B |
| 2,237,308 | 4/1941 | Larson | 220/1 B |
| 2,395,685 | 2/1946 | Schmitz | 220/5 A |
| 2,849,143 | 8/1958 | Roeske | 220/1 B |

*Primary Examiner*—George E. Lowrance

*Attorney, Agent, or Firm*—Blakely, Sokoloff, Taylor & Zafman

[57] ABSTRACT

Large storage tank structures having relatively smooth internal surfaces free of any unwelded seams and gaps and particularly free of gaps between meeting parts which may change substantially with differential expansion and other forces thereon are disclosed. This allows the application of suitable corrosion-resisting coating materials to the internal surfaces of the tank which coating will maintain its integrity throughout the expected useful life of the coating and which will be conducive to meaningful inspection and local and/or entire recoating to prolong the life of the tank. The structures disclosed eliminate any gaps between tank members which are not sealed from the inside by continuous welds on the inside of the structure and accordingly, eliminates gaps which will tend to open and close under normal stress variation on the structure to cause a local failure of any corrosion-resisting coating thereon and allow the passage of corrosive materials in the tank for rapid corrosion of the tank structure and the early failure thereof. The structures of the present invention in general also provide continuous welds on each joint of the external structure so as to externally seal the structure from intrusion of water and other corrosive materials from without, thereby providing a large storage tank construction which has a maximum useful life and is readily inspectable and maintainable both internally and externally. Various embodiments are disclosed.

13 Claims, 21 Drawing Figures

LARGE STORAGE TANK STRUCTURES

BACKGROUND OF THE INVENTION

1. Field of the Invention

The present invention relates to the field of large storage tank structures.

2. Prior Art

Large above ground storage tanks are frequently used for the storage of various material such as water, petroleum products and the like. The tanks of the type which are the subject of the present invention are the large tanks used either singularly, or more often in plurality, to store large quantities of material such as, by way of example, crude oil and/or processed petroleum products at an oil refinery. In general such tanks are fabricated by welding up a tank floor of steel plate on an appropriate foundation, and then welding curved side plate sections to the floor and butt welding the sections to themselves to build up the cylindrical sidewall of the tank to the desired height. The roof structure is supported either by a post at the center of the tank or alternatively, a center post and a pattern of posts therearound to provide intermediate support for the roof between the center post and the tank circumferential wall, depending upon the size of the tank in question. In general the center post, and any other posts within the ultimate tank enclosure, are used to support a rafter system, typically of I beam construction bolted to the posts and connected to the sidewalls of the tank, with steel plate panels welded thereover to complete the tank enclosure. The roof plates, generally rectangular segments, are continuously welded only on the outside of the tank because of tradition, economics and the inaccessibility of many of the seams, etc., from within the tank, particularly because of the rafter construction. Most tanks are then coated on the inside with a suitable coating material to protect the steel used in the tank construction, and to isolate the steel from the materials to be stored therein.

Various such coating materials are well known in the prior art and readily commercially available to provide a tenacious and highly protective coating on steel to prevent corrosion thereof even by materials known to be very corrosive to unprotected steel. However, there are various characteristics of tanks of the foregoing construction which have been found to overtax the capabilities of such materials, resulting in inadequate coatings and/or the development of cracks therein which allow the passing of corrosive materials within the tank into gaps such as gaps between the roof plate and the rafters, grossly accelerating the deterioration of the roof structure and resulting in a very premature failure thereof. In particular, because the roof rafters are internal, one can reasonably easily coat and inspect the coating on any downward facing surfaces of the I beam rafters and on the upper part of the vertical portion of the I, but can neither conveniently coat nor inspect the lower part of the vertical portion of the I beams of the upward facing surfaces, Further, the portion of the roof plates above the I beams cannot be coated. Obviously corrosion in these regions will quickly weaken the intended support, leading to a very premature sagging or failure of the roof structure.

Also the effects of differential expansion and the working of unwelded gaps and overlaps must be appreciated. By way of example, of one overlaps the edges of two steel plates, such as roof panels, and continuous welds the two panels from the outside, the inside gap may be very low, or even almost zero depending upon how well the plates fit before welding. Such a gap will readily coat with a protective coating to prevent the seepage of any material being stored in the tank into the gap in the region of the overlap of the two plates. If however, tension is applied across the weld, the unwelded gap will tend to open up to perhaps many times its original size, eventually if not immediately causing the cracking or splitting of the coating material at that location to allow penetration of the material within the tank into that gap. In other instances where one member supports another but is not welded thereto, differential expansion may cause lateral motion between the two members, again substantially immediately splitting the protective coating to allow penetration of corrosive materials into the gap between the two members. In that regard it must be recognized that differential expansion in tanks of this type can be quite large, in part because of the cumulative effect of even relatively small temperature differences over the relatively large spans involved, and in part because of the quite substantial temperature differences which frequently exist under certain conditions. By way of example, the sidewalls of a tank are reasonably well sheltered from the midday sun and accordingly, are not significantly heated thereby, particularly when heat sinked against the contents of a substantially filled tank. On the other hand, the roof of a typical tank is fairly directly exposed to the middway sun and not generally heat sinked to the materials therein, and accordingly can experience large temperature fluctuations both daily, and particularly over seasonal extremes. In other situations a tank may be used to store the intermediate products or end products of a particular process which as a result of the process have an elevated temperature whereby the walls and floor of the tank will expand in accordance with that elevated temperature, whereas the roof will tend to be cooled by the outside environment. Consequently, it is common for cracks or splits to occur in the coating in the region of unwelded overlaps, supports, etc. to expose unprotected steel to the corrosive effects of the tank contents.

U.S. Pat. No. 2,395,685 discloses a storage tank constructed from substantially thin plates of corrosion resistant alloy. The edge portions of the thin plates are welded to channels in the manufacturing plant, which channels may be bolted together during erection in a manner to define the tank enclosure. Thereafter strips of corrosion resistant material are welded over the inner seams of the tank to provide a relatively smooth inner tank surface as in the present invention. However, the structure and method of fabrication of the tank of the U.S. Pat. No. 2,395,685 patent is entirely different from that of the present invention, and is not suitable for the construction of large tanks as is the present invention.

U.S. Pat. No. 2,849,143 discloses a tank design for the storage of corrosive liquid materials in which rough edges such as bolts, overlays, exposed I beams and exposed channels are eliminated and which provides a substantially continous interior surface to serve as a base for a corrosion resistant material. For this purpose the various rafters and girders are formed as closed channel members to avoid concave surfaces within the tank. The patent is relevant as addressing some of the same problems with large storage tanks as the present invention, though is quite different from the present invention in that U.S. Pat. No. 2,849,143 addresses the problem by controlling the roof structure within the tank, whereas the present invention essentially removes the roof structure from within the tank.

BRIEF SUMMARY OF THE INVENTION

Large storage tank structures having relatively smooth internal surfaces free of any unwelded seams and gaps, and particularly free of gaps between mating parts which may change substantially with differential expansion and other forces thereon are disclosed. This allows the application of suitable corrosion-resisting coating materials to the internal surfaces of the tank, which coating will maintain its integrity throughout the expected useful life of the coating and which will be conducive to meaningful inspection and local and/or entire recoating or prolong the life of the tank. The structures disclosed eliminate any gaps between tank members which are not sealed from the inside by continuous welds, and accordingly eliminates gaps which will tend to open and close under normal stress variations in the structure to cause a local failure of any corrosion-resisting coating thereon. The structures of the present invention in general also provide continuous welds on each joint of the external structure so as to externally seal the structure from intrusion of water and other corrosive materials from without, thereby providing a large storage tank construction which has a maximum useful life and is readily inspectable and maintainable both internally and externally. Various embodiments are disclosed.

DETAILED DESCRIPTION OF THE INVENTION

Figure 1:
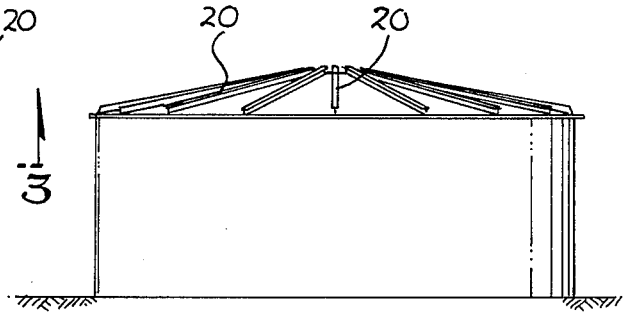
FIG. 1 is a side view of a tank constructed in accordance with one embodiment of the present invention.

First referring to FIG. 1, a side view of a tank built in accordance with one embodiment of the present invention may be seen. The tank illustrated in a single bay storage tank having a central support post for supporting a plurality of radially disposed rafters and roof panels of the conical shape roof construction. In general, the floor and sidewall of the tanks of the present invention may be fabricated in accordance with prior art techniques, as such techniques result in internal floor structures and sidewall structures which are relatively smooth and unencumbered by beams, girders and the like so as to be relatively easily and reliably coated and inspected as required. In general, such construction proceeds by the preparation of an appropriate foundation, and in the positioning and welding together of floor plates to make up the bottom of the tank. In some instances the floor plates are butt welded together so that the entire floor, including the surface thereof adjacent the periphery to which the sidewalls will be welded, is substantially flat. In other instances, at least some of the floor plates may be lapped and welded to avoid the precise cutting requirements of the plates, though in such instances, at least the region adjacent the periphery of the floor may be appropriately cut, bent downward and butt welded so that the lap weld fairs into a butt weld adjacent the edges of the floor to provide at least a flat peripheral region on which the side walls will be constructed. Even with such lap welds however, no special problems are encountered in the coating of the floor or the inspection of the coating, as no surfaces are hidden or sheltered during the coating or inspection, and all welds are continuous so that there are no gaps which may open and close under loads due to differential expansion and other causes.

Once the floor is completed (the coating of the floor and other tank surfaces proceeding only after the fabrication of the entire tank is complete) the side walls are erected. In general the side walls are comprised of a plurality of rectangular steel plate panels formed to the desired radius of curvature and welded to the floor adjacent the periphery thereof and butt welded to each other to build up the cylindrical side walls of the tank to the desired height. All of these welds of course are also continuous welds, with the welding of the side plates to the floor plate being done from both inside and outside so that there are no gaps or spaces exposed either internally or externally. Also the side plates are butt welded to each other in such a manner that the welds extend through the full thickness of the plates, again providing substantially smooth surfaces on both the internal and external surfaces of the tank.

At this point in the construction one would normally put the center column in position and weld it to the floor if not previously done, construct a system of rafters supported by the center column and side walls, and then lay roof panels over the rafters, and continuous welding the roof panels to each other from the outside. In accordance with the present invention however, the roof structure is fabricated substantially differently, as is illustrated in FIGS. 2 through 6 for the embodiment of FIG. 1, and in the remaining figures for various other illustrative embodiments.

Figure 2:
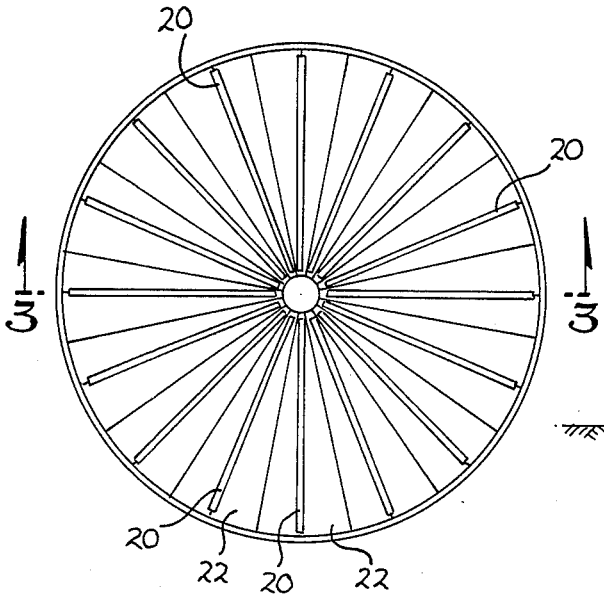
FIG. 2 is a top view of the tank of FIG. 1.

As illustrated in FIGS. 1 and 2, the rafter structure of the present invention is substantially external to the tank. In particular, the individual rafters 20 in this embodiment extend radially from the center of the tank to the side walls thereof, each of the rafters 20 supporting an associated roof panel 22, which in combination generally define the conical roof of the tank.

Figure 3:
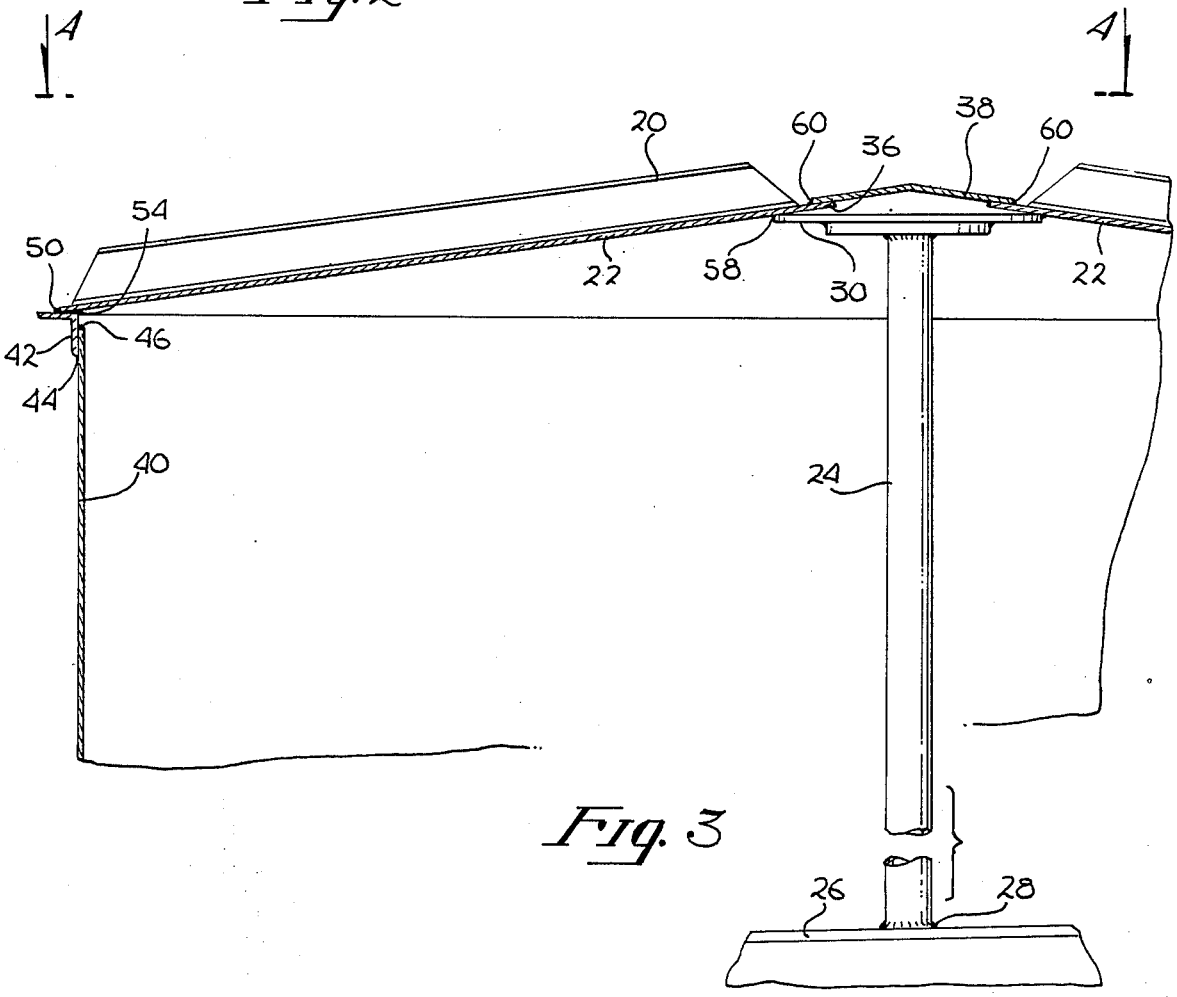
FIG. 3 is a partial cross sectional taken along line 3—3 of FIG. 2.
Figure 4:
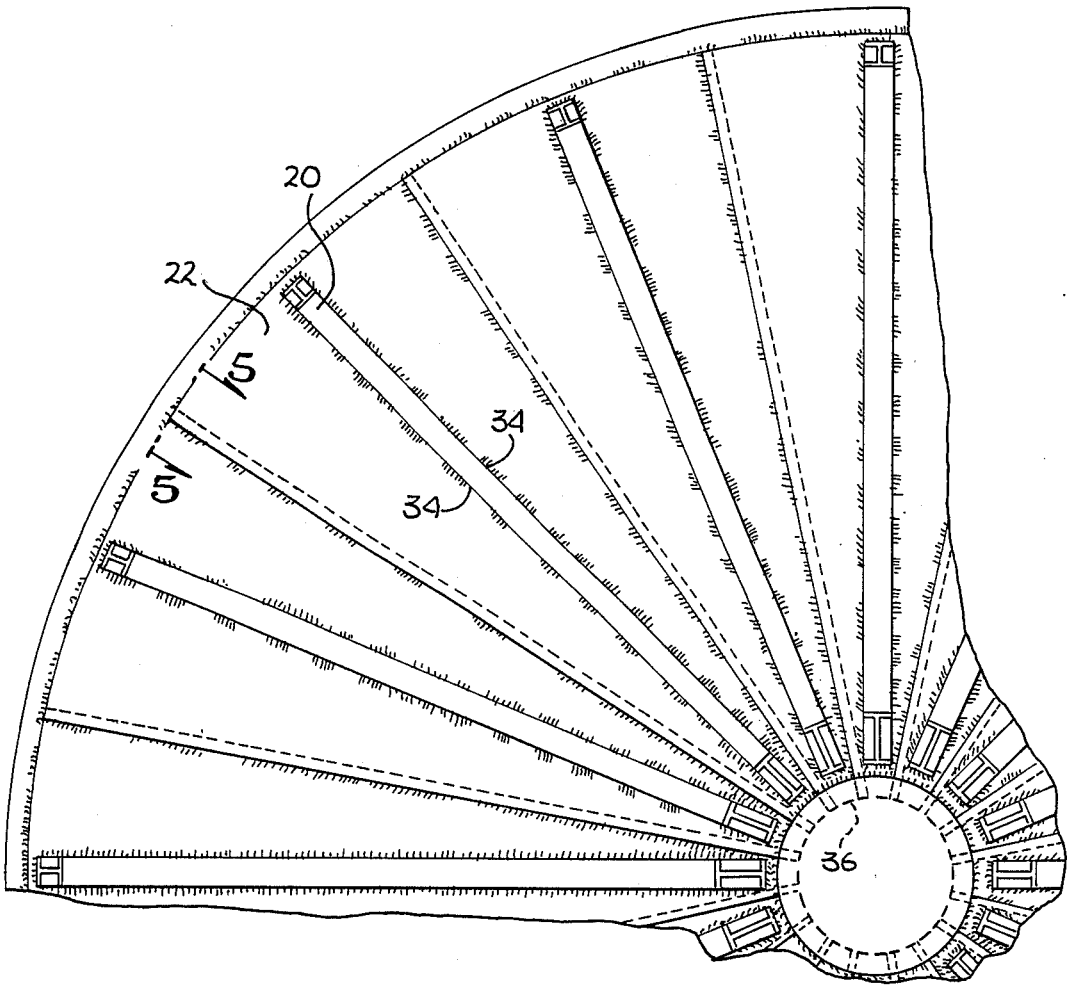
FIG. 4 is a top view taken along line 4—4 of FIG. 3, illustrating various details of the roof construction.
Figure 5:
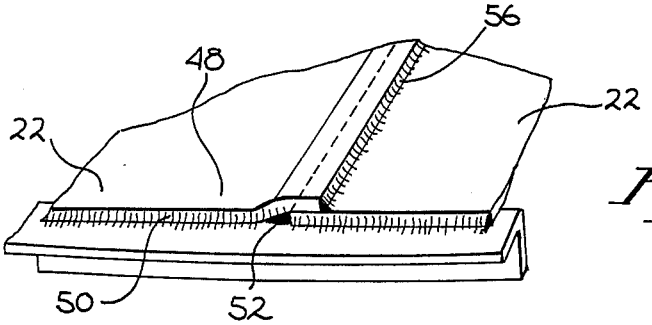
FIG. 5 is a cross section taken along line 5—5 of FIG. 4.
Figure 6:
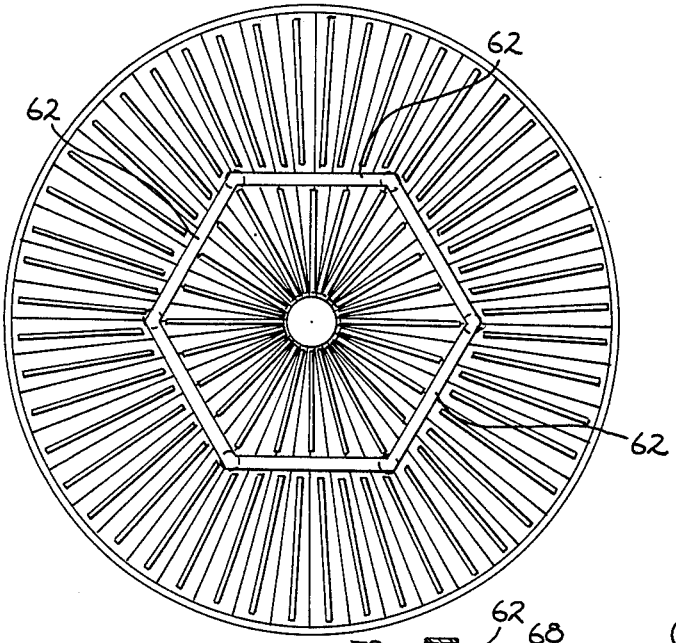
FIG. 6 is a top view of an alternate embodiment tank construction.

Details of the foregoing structure are shown in FIGS. 3 through 5. The tank of this embodiment, being a single bay tank, has a single center support post 24 welded to the floor 26 of the tank by a continuous weld 28. The top of the round post 24 defines a support platform for the rafters comprising support plates 30 continuous welded to each other and to the post. The roof itself is comprised of various approximately triangular shaped panels 22, each with a rafter 20 welded to the top thereof by continuous welds 34 on both sides of the rafter. The cutting of the panels to the desired shape, as well as the cutting of the rafters themselves and the welding of the rafters to the panels is generally done in-plant, the welds being readily made by automated equipment because of the nature of the weld and the relative accessability of the weld region. In the embodiment shown, the rafters 20 are shown as being welded to the approximate middle of the generally triangular shaped or pie shaped panels 22, though this is by no means a limitation of the invention, as the rafters need not be so centrally located. Also, as illustrated in FIGS. 3 and 4, the rafters 20 extend to a position of significant overlap with the edge of plate 30 supported on post 24 (see specifically FIG. 3) though the roof panels 22 themselves have an inner end 36 preferably extending radially inward somewhat beyond the adjacent end of the respective rafter so as to provide a surface to which a conical central cap 38 may be welded in a manner yet to be described. Similarly, the outer ends of each of the rafters 20 in this embodiment generally extend outward to a position slightly beyond the sidewall 40 (see FIG. 3) of the tank so as to rest on a top angle 42 welded to the outside top edge of the tank (again by continuous welds in both regions 44 and 46).

In general, it would be convenient to have the roof panels 22 placeable in position so that the adjacent edges thereof could be continuous butt welded to each other and welded in position around the edge of the tank. However, this is neither required nor practical, as the accuracy required in the cutting of the panels and in the erection of the support beam and sidewall of the tanks is impractical, and the onsight trimming of the panel so as to appropriately butt is unnecessarily expensive. Instead, the panels 22 are cut at the factory so as to predictably overlap when placed in position on the remainder of the tank structure so as to provide a lap joint which may be readily continuously welded from within the tank as well as outside the tank. In that regard, FIG. 5 illustrates a view of the region of overlap of two adjacent panels 22 as viewed from the outer edge thereof. As shown in the figure, the upper panel in the overlap may be readily bent down at the outer edge thereof in region 48 so as to allow a continuous weld 50 between the panels 22 and top angle 42, even in region 52 now substantially closed because of the local bending of the upper panel. In addition to the continuous weld 50, a continuous weld 54 (see FIG. 3) is also made around the inside of the tank, welding the inside surface of the panels 20 to the top angle (or alternatively, to the inside edge of the tank wall 40). In general, the pitch of the roof of the tank will be such that the gap between the roof panels 22 and the top angle 42 from within the tank will not be too much to conveniently weld, considering the relatively narrow separation between inner and outer welds, though in instances where the gap is larger than desired, the outer edge of the roof panels 22 and rafters 20 may be bent down on site to be flatter than the general conical shape of the roof, and/or the top angle 42 may deviate slightly from a right angle so as to more closely match the pitch of the roof.

In general, the continuous weld such as weld 56 (FIG. 5) welding the panels 22 together from the outside, the corresponding continuous weld on the inside of the tank and the continuous welds 50 and 54 around the periphery of the roof can be readily made with automatic equipment, as the adjacent surfaces are in general all relatively smooth and unobstructed. In that regard, while the inside weld corresponding to weld 56 is an overhead weld, a welding tractor held to the roof by suitable magnets may readily be constructed for this purpose. Accordingly, while there are a reasonable number of continuous welds in the roof structure of the present invention, a significant percentage of which are continuous overheld welds, the region of the welds is generally unobstructed, whereby the use of automated equipment allows the welding to proceed relatively rapidly without the time and tedium of manual overhead welds.

The final operation prior to the finishing of the inside and outside surfaces of the tank is the welding of center cap 38 in position over the inner ends of the panels 22 (See FIG. 3). The cap 38 itself may readily be fabricated in the plant to have a pitch equal to or even slightly greater than the pitch of the tank roof so as to assure that the cap, when placed in position, will rest on its outer edges on panels 22 to more readily facilitate the continuous weld 60 around the periphery of the cap.

Figure 8:
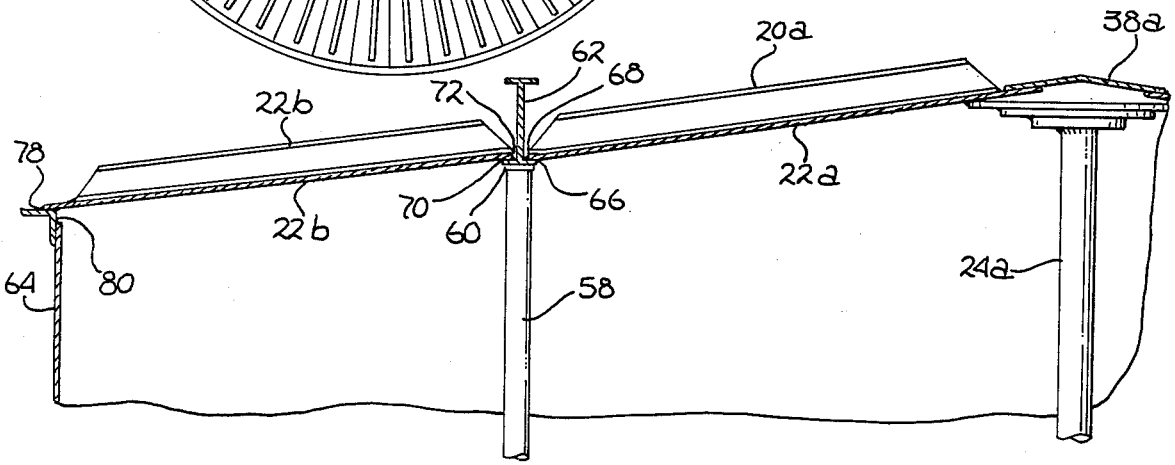
FIG. 8 is a partial cross section taken along line 8—8 of FIG. 7.
Figure 7:
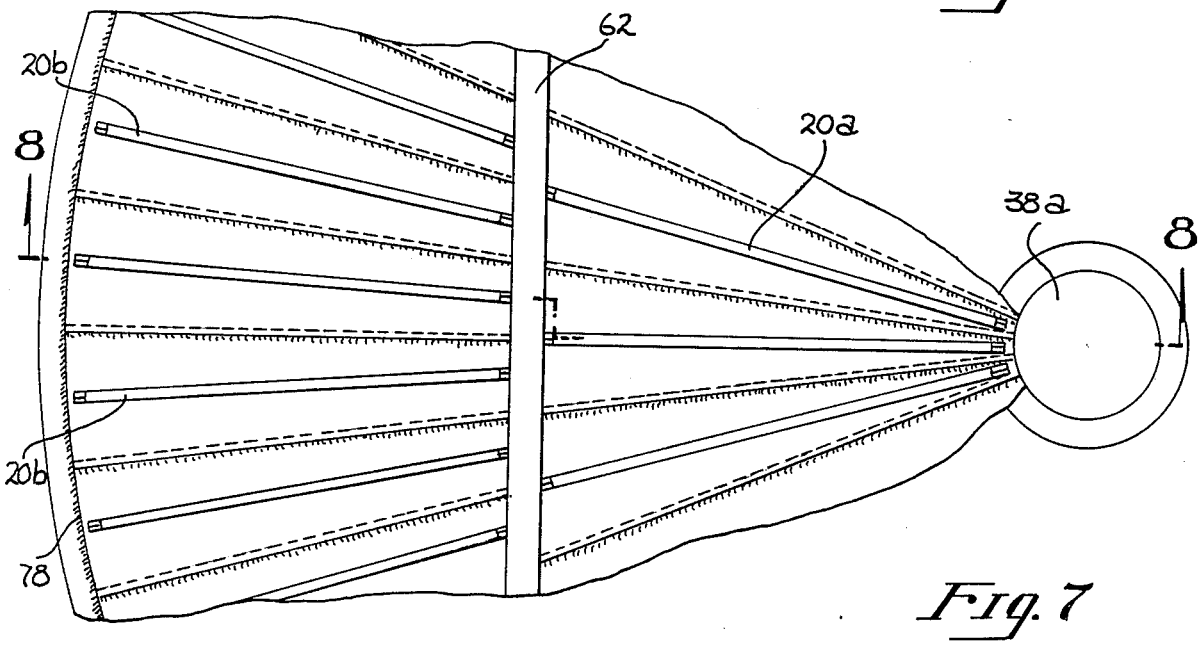
FIG. 7 is a view of a portion of the top of the tank of FIG. 6 taken on an expanded scale to illustrate additional details thereof.
Figure 9:
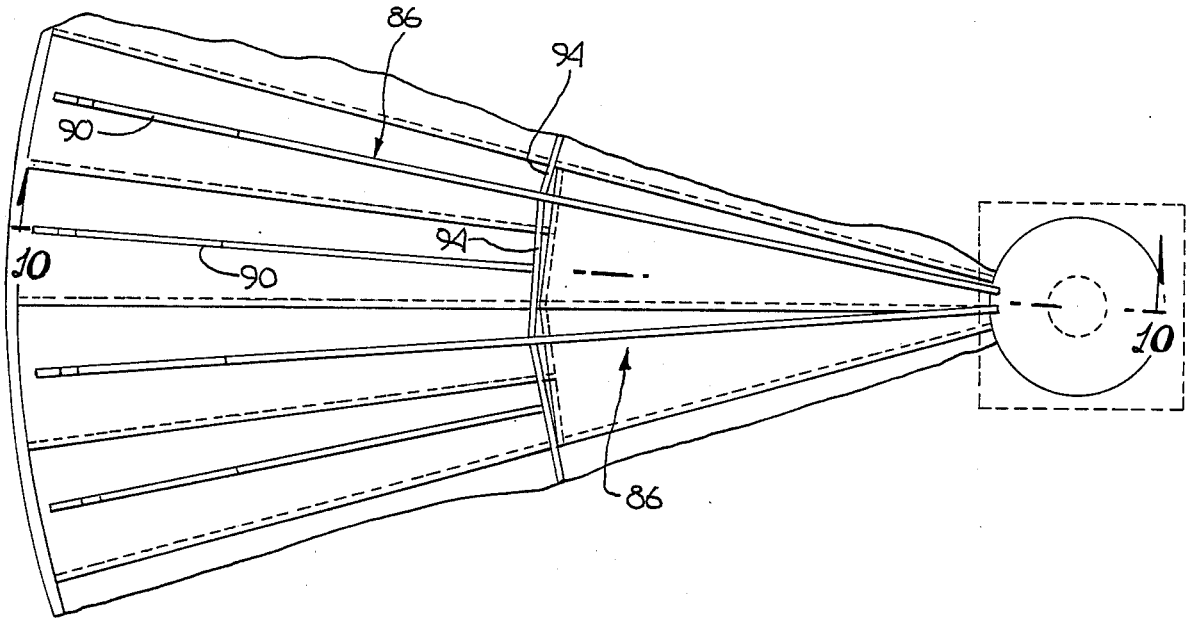
FIG. 9 is a top view of a portion of the roof of a further alternate embodiment tank illustrating a truss-type roof construction thereof.

Now referring to FIGS. 7, 8 and 9, details of the construction of a multiple bay tank structure may be seen. In this embodiment, not only is there a center post 24*a* and associated roof structure similar to center post 24 and the associated roof structure of the embodiment of FIGS. 1 through 5, but in addition, an array of additional support posts 58 are provided. The additional posts 58 of course are continuous welded to the floor of the tank and may have a small support plate 60 continuous welded to the top thereof. Supported by the posts 58 are girders 62 providing an intermediate support between the center post 24*a* and the wall 64 of the tank. In particular, the outer end of panels 22*a* as previously continuous welded to rafters 20*a* are supported on the upper surface on the lower portion of the I beam girder 62 and continuously welded in regions 66 from within the tank and regions 68 outside the tank. As before, adjacent roof panels 22*a* will be lapped as was illustrated in FIG. 5 for the previously described embodiment, though may be readily bent downward in the region of the lap as desired to more readily facilitate the continuous weld. Similarly, while normally the pitch of the roof will be such that no excessive gaps will appear in the region of the continuous weld 66, panels as well as the rafters may be locally flattened in the region of the I beam girder 62 to substantially close the gap prior to welding in region 66 if the gap is otherwise excessive for the continuous weld.

In a similar manner, the outer panels 22b, together with their associated rafters 20b, are continuous welded along the inner edge thereof in regions 70 internal to the tank and 72 external to the tank, again panels 22b and rafters 20b being bent downward adjacent the vertical portion of the I beam rafter 62 if required to adequately close the gap for welding. While one cannot conveniently hammer in this region because of the extent to which it is sheltered by the upper cross piece of the I beam girder, the inner edges may readily be pounded down as required by putting a bar against the region of the desired bend and pounding on the bar at a point above the top of the I beam girder. Alternatively, the required bends on both the inner and outer panels may readily be made by inserting a suitable hydraulic jacking device between the region of the desired bend and the inner surface of the top portion of the I of I beam girder 62, the panels and rafters yielding as desired before the stronger I beam. The region of support of the outer portion of the outer panels 22b and rafters 20b on the tank wall 64 may be the same as illustrated in FIG. 3 and described herein with respect hereto.

Figure 10:
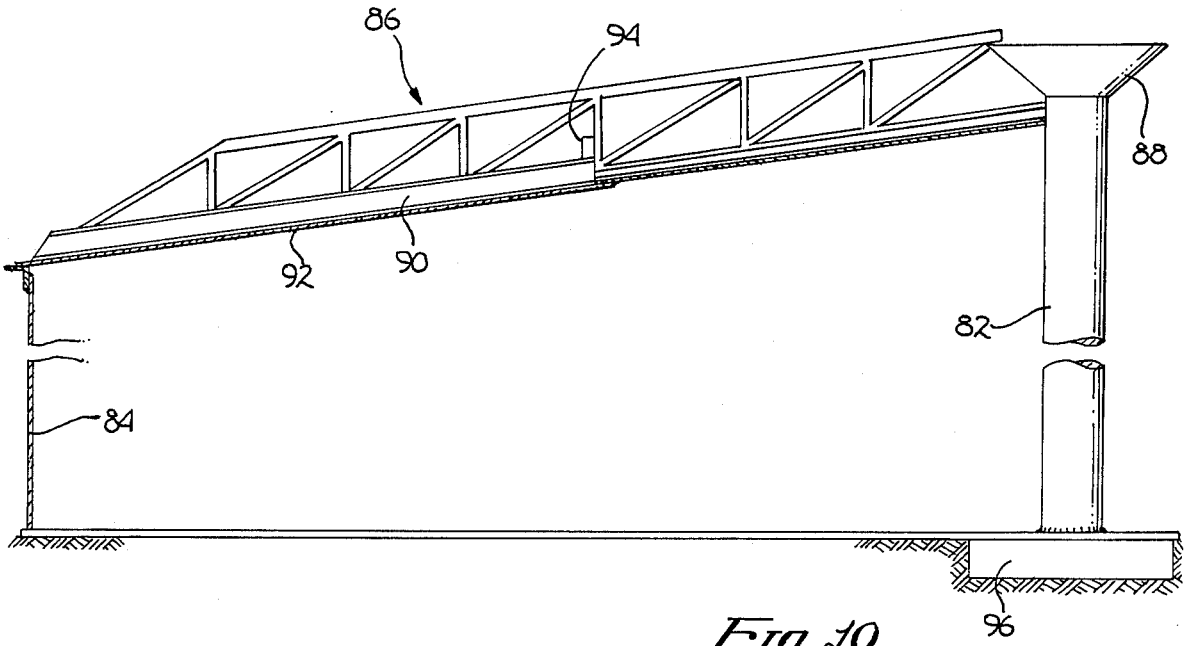
FIG. 10 is a partial cross section of the tank of FIG. 9 taken along line 10—10 thereof.
Figure 11:
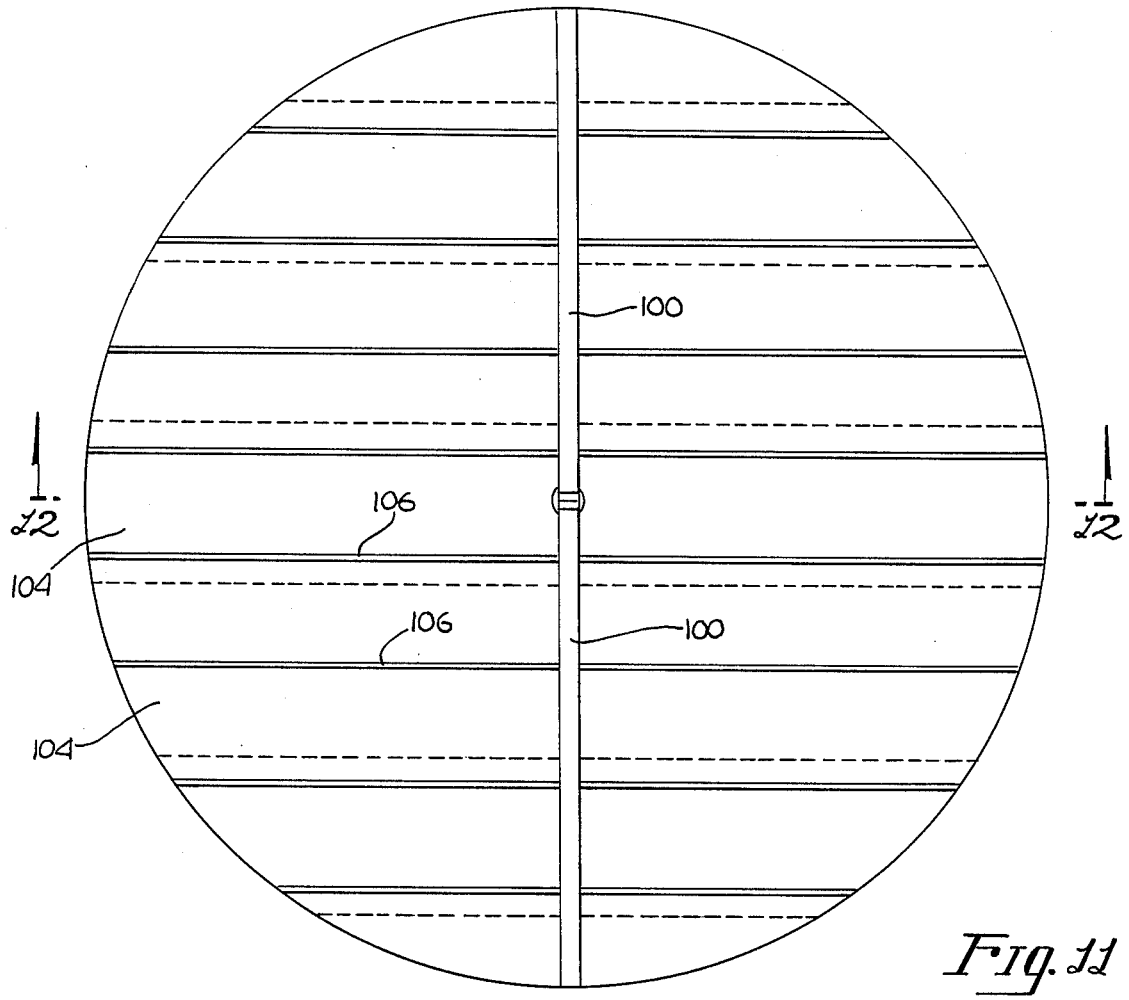
FIG. 11 is a top view of a still further alternate embodiment utilizing a rectangular array of roofing panels and rafters for the roof construction.

Now referring to FIGS. 10 and 11, a still further embodiment of the present invention may be seen. This embodiment illustrates a form of tank wherein the span from the center post 82 to the tank wall 84 is too large to be conveniently supported by ordinary rafters and yet additional posts within the tank are not desired. Accordingly, in this embodiment, truss-like structures generally indicated by the numeral 86 span from the center support post 82 and a cone-like top 88 thereof to the outer wall 84 of the tank. Because of the tapering of the roof panels as shown in FIG. 10, every other outer panel in this embodiment includes a rafter 90 continuous welded to an associated roof panel 92. These rafters 90 are supported from the truss structures 86 by headers 94 welded between the truss structures and to the top of a respective rafter 90. As before, of course all internal joints as well as external joints in this tank structure may be readily continuous welded to again achieve the desired results of the invention. For this type of tank of course one normally provides a special footing 96 for the center post because of the extremely large concentrated load thereon.

Figure 12:
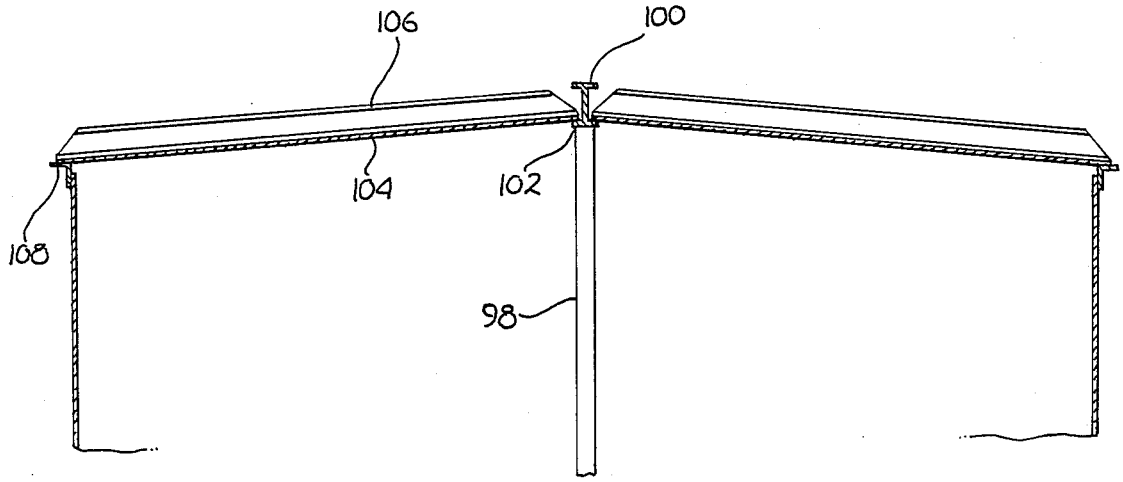
FIG. 12 is a partial cross section taken along line 12—12 of FIG. 11.
Figure 13:
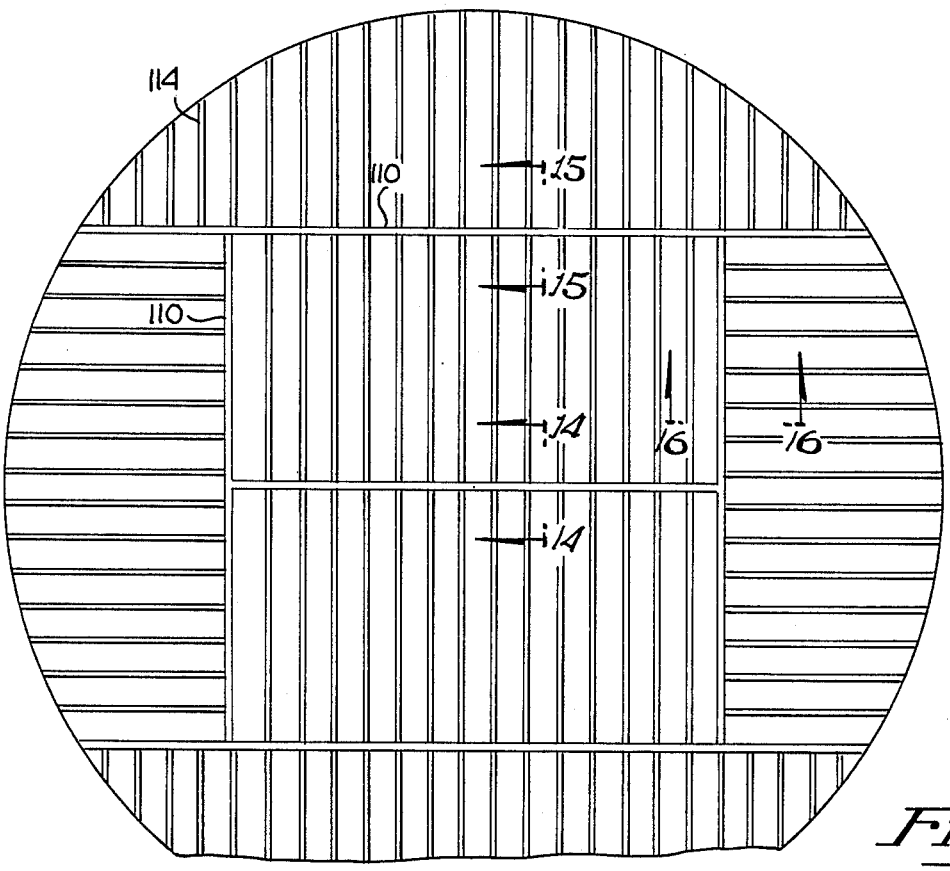
FIG. 13 is a top view of an alternate embodiment roof structure particularly suited to the larger multiple post storage tanks.

In the embodiments hereinbefore described, a generally radial pattern of rafters has been used, either extending from a center platform supported by a center post to the tank wall, as in the embodiment of FIGS. 1 through 5, or in some multiple pattern as in the embodiments of FIGS. 7 through 11. In general, if one assumes some practical maximum limit on the width of a roof panel for each rafter, such radial rafter and roof panel layouts tend to require more rafters and more welding per unit roof area than necessary, as the maximum roof panel width per rafter is only achieved at the outer ends of the roof panels and rafters. Also, the tapered nature of the panels requires a lot of panel cutting and results in much more scrap than necessary. Finally, these radial patterns tend to cause congestion around the inner ends of the panels and rafters, which can make welding, painting, etc., in that region somewhat more difficult that at the outer ends where the rafters, panel lap welds, etc are more openly spaced. For these reasons, rectangular roof panel and rafter patterns are sometimes used, which may be incorporated with the present invention as illustrated in FIGS. 12 and 13. Here the center post 98 supports a pair of I beam girders 100 which together, as supported by the post 98, span the diameter of the tank. The girders 100 are continuous welded in region 102 to the post 98. Alternatively, of course a support platform may be welded to the post 98 with the girders welded thereto. The various roof panels 104 have continuous welded to the upper surface thereof rafters 106, with one end of the roof panels and rafters welded to girders 100 in the same manner as described with respect to the welding of the roof panels and rafters to I beam 62 in the embodiment of FIG. 9, and the other end of the roof panels and rafters continuous welded to the top angle 108, both internally and externally as also described with respect to FIG. 9. The net result of this embodiment, as may be seen in FIG. 12, is the elimination of the congestion adjacent the center and the problems associated therewith as hereinbefore described. Also note that the roof panels need not be cut along the length thereof as with the triangular or pie shaped sections of the previously described embodiment, but rather need only be cut transversely, a substantially shorter cut and one generally resulting in a more efficient use of material and less scrap. Finally, note that some panels 104 have a pair of rafters 106 continuous welded thereto, with other panels having a single rafter 106 continuous welded to the center thereof. In general, in order to prevent excessive sagging, the rafter separation normally will be held to some predetermined maximum such as, by way of example, 5.5 feet. The panels themselves however, being a standard mill run, may be substantially wider than this, so that the desired rafter spacing may be obtained with two rafters on alternate panels and one rafter on the other panels, which of course reduces the welding required in the lap welding of adjacent panels as well as eliminating the need for longitudinal cuts on the panels.

Figure 14:
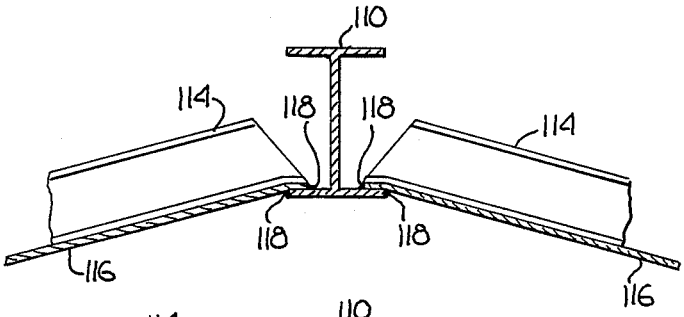
FIGS. 14, 15 and 16 are cross-sections taken along lines 14—14, 15—15 and 16—16, respectively of FIG. 13.
Figure 15:
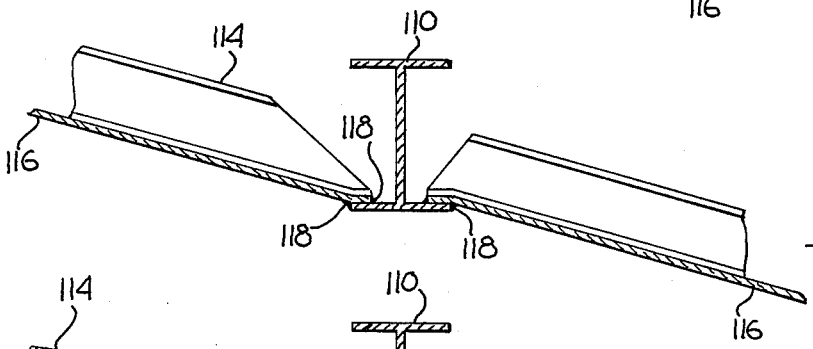
Figure 16:
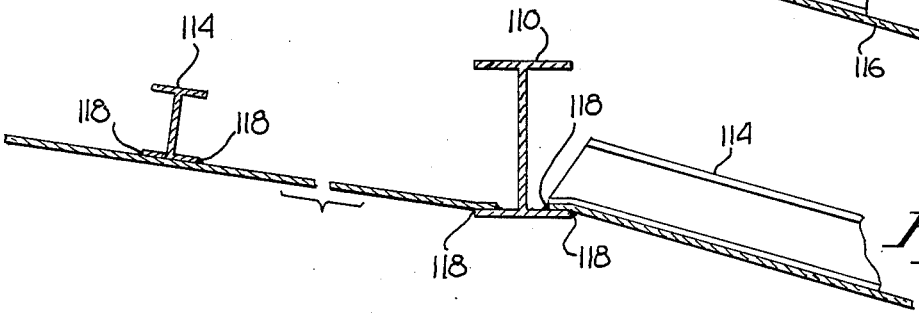

Now referring to FIG. 13, the top view of a tank illustrating a still further alternate roof construction may be seen. This tank would be a relatively large tank of approximately 70 to 160 feet in diameter, utilizing a rectangular pattern of nine support posts 112 as illustrated schematically in FIG. 20. This roof construction is comprised of a system of girders 112 supported by the posts, which girders in turn support the roof panels and associated rafters 114. In this example, certain of the rafters and roof panels extend in one direction and others in an orthogonal direction with respect thereto. By way of example, FIGS. 14 and 15 show cross sections taken along lines 14—14 and 15—15, respectively, of FIG. 13, these cross sections being taken in a plane parallel to the rafter center lines for the associated areas of the roof. As before, the panels 116 with rafters 114 continuously welded thereto are in turn continuously welded to the girders 110 by the continuous welds 118. FIG. 16, on the other hand, illustrates a cross section along line 16—16 of FIG. 13, taken through a region where the rafters are extending in orthogonal directions. At the left of FIG. 16 is a rafter 114 continuous welded to the roof panel, with the roof panel and rafter continuous welded to the girder at the ends of the rafter in the same manner as illustrated in FIGS. 14 and 15. To the right of FIG. 16 is a portion of the roof with the rafters perpendicular to the girder, again like FIGS. 14 and 15, as opposed to being parallel to the girder as in the left of the figure.

Figure 17:
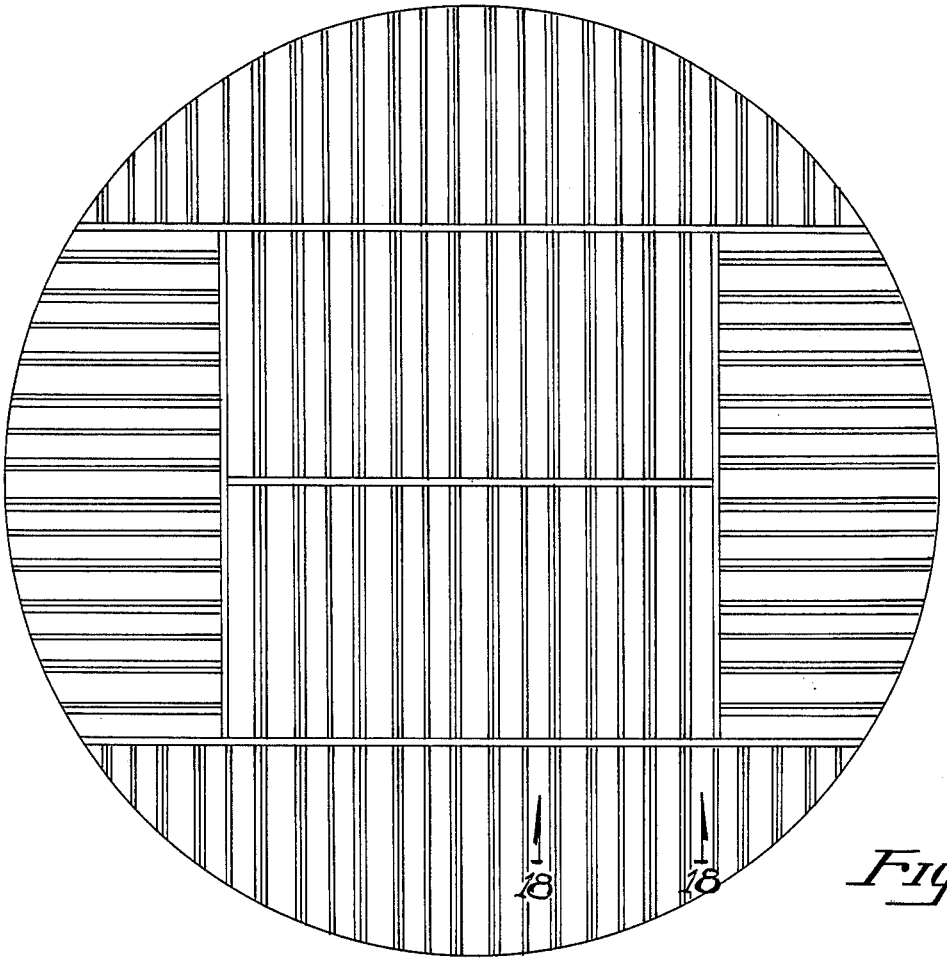
FIG. 17 is a top view of a storage tank having a roof construction similar to that of FIG. 13, but with two support rafters per roof panel for alternate panels.
Figure 18:
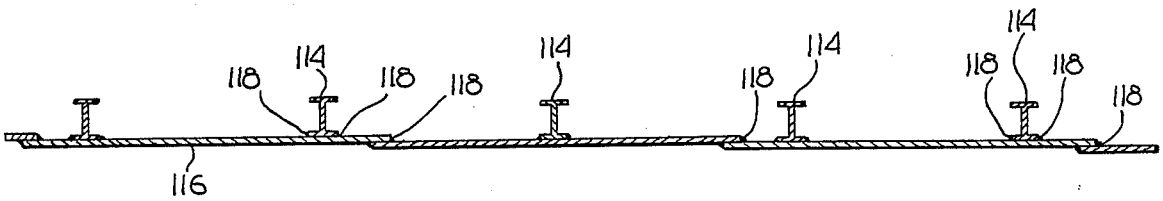
FIG. 18 is a cross section taken along line 18—18 of FIG. 17.

In the embodiments hereinbefore disclosed, a single rafter per roof panel has either been shown or assumed. While one would normally want at least one rafter per roof panel to help support that panel until welded to adjacent panels, etc. during the tank construction, there may be some panels without a rafter and entirely supported by the edges of other panels or by another panel and a girder flange. Also, there may well be instances where for various reasons more than one rafter per roof panel may be desired or required. By way of example, longer spans, special loading requirements or other considerations may make more than one rafter per roof panel necessary or desirable. By way of specific example, an embodiment similar to that of FIG. 13 is shown in FIG. 17, with a cross section taken through a portion of the roof thereof being shown in FIG. 18. In this example alternate roof panels 116 have two rafters continuous welded thereto along regions adjacent the edges of the panels, with the inbetween panels having a single rafter continuous welded thereto at the approximate center thereof. Thus in the final assembly, the roof panels or plates are supported by a rafter assembly of equally spaced rafters, but with the rafters having a spacing of approximately two-thirds of the width of each roof panel.

Figure 19:
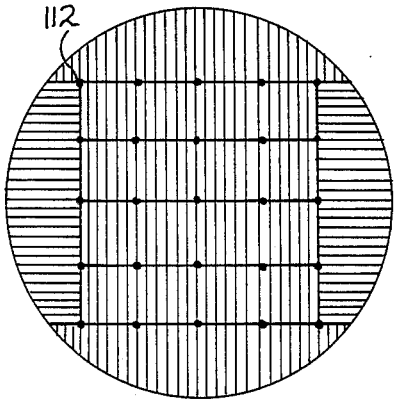
FIGS. 19 through 21 are schematic top views illustrating roof constructions and post configurations suitable for, by way of example, tanks 120′ to 240′ in diameter, 70′ to 160′ in diameter and up to 90′ in diameter, respectively.
Figure 20:
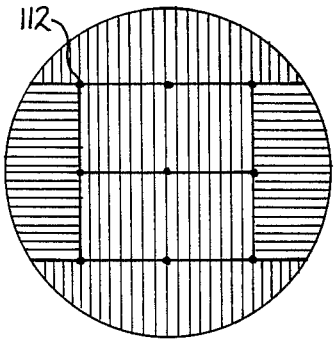
Figure 21:
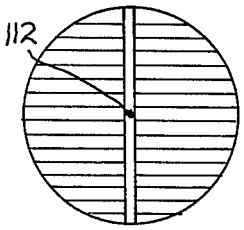

Now referring to FIGS. 19, 20 and 21, tank structures particularly suited for various size tanks are illustrated. In particular, FIG. 21 illustrates a relatively simple single post tank construction in accordance with the present invention, which construction is suitable for tanks up to approximately 90 feet in diameter. The construction in FIG. 20, on the other hand (like that of FIG. 13 or 17), is a nine post structure suitable for use for storage tanks of approximately 70 to 160 feet in diameter. Finally, the structure shown in FIG. 19 is suitable for storage tanks from approximately 120 feet in diameter to 240 feet in diameter. Obviously these three structures are by no means limiting structures, but rather merely exemplary of structures readily fabricated in accordance with any particular requirement for such storage tanks.

There has been described herein various embodiments of large storage tank structures and methods of fabricating the same which result in a substantially smooth internal tank construction having continuous welds and thereby allowing the easy coating of the internal surface with suitable corrosion resistant materials and the easy inspection of such coatings to provide a highly corrosion resistant long-life storage tank. The methods and apparatus of the present invention also allow the exterior surface of the tank to be comprised of a continuous welded structure thereby allowing the easy painting of the external structure for corrosion resistance and preventing the bleeding of corrosion from unwelded gaps, etc., in the structure. While specific preferred embodiments of the invention have been specifically disclosed and described herein, it will be understood by those skilled in the art that various changes in form and detail may be made therein without departing from the spirit and scope of the invention.

I claim:

1. A storage tank comprising:

a welded steel floor having all continuous welds;

a welded steel cylindrical side wall continuous welded to said floor from both sides of said side wall;

a plurality of roof panels, at least some of said roof panels having at least one rafter continuous welded to the upper surface thereof spaced apart from the edges of said panels such that said upper surface of said panels remains substantially free from any such rafters immediately adjacent to said edges of said panels;

each of said roof panels being continuous welded along its edges directly to the edges of adjacent panels to form the roof of said storage tank with said rafters external thereto, said roof panels adjacent the periphery of said roof being continuous welded at least indirectly to the upper periphery of said side wall by continuous welds, whereby said floor, side wall and roof panels define a continuous welded storage tank enclosure.

2. The storage tank of claim 1 wherein a top angle is continuous welded adjacent the upper periphery of said side wall, said roof panels adjacent the periphery of said roof being continuous welded to said top angle.

3. The storage tank of claim 2 wherein said roof panels adjacent the periphery of said roof are continuous welded to said top angle from within and without said tank.

4. The storage tank of claim 1 wherein each of said roof panels is continuous welded to adjacent panels by being overlapped therewith and continuous welded thereto from both within and without the tank enclosure.

5. The storage tank of claim 1 further comprised of additional roof structure support means for supporting said roof panels and rafters.

6. The storage tank of claim 5 wherein said additional roof structure support means comprises at least one vertical post continuous welded to the floor of said tank and at least indirectly continuous welded to the lower surface of roof panels supported thereby.

7. The storage tank of claim 5 wherein said additional roof support means comprises a truss structure above said roof panels.

8. The storage tank of claim 7 wherein said truss structure is continuous welded to selected roof panels and is supported, at least in part, by said side wall.

9. The storage tank of claim 8 wherein said additional roof structure support means comprises at least one vertical post continuous welded to the floor of said tank and at least indirectly continuous welded to the lower surface of roof panels supported thereby.

10. The storage tank of claim 1 wherein said storage tank further includes a vertical post continuous welded to the floor of said tank and at least indirectly continuous welded to the lower surface of roof panels supported thereby, said roof panels being tapered so as to have side edges extending approximately radially from said post.

11. The storage tank of claim 10 further comprising a cap continuous welded to the upper surface of the ones of said roof panels supported by said post.

12. The storage tank of claim 1 wherein said storage tank further includes a vertical post continuous welded to the floor of said tank, and I beam girders, the lower surface of said I beam girders being continuous welded at least indirectly to said post and the upper periphery of said side wall, one end of at least some roof panels overlying one side of the lower flange portion of a respective I beam girder and continuous welded thereto from both within and without said tank disclosure.

13. The storage tank of claim 1 wherein said storage tank further includes a plurality of spaced apart posts, each continuous welded to said floor, and I beam girders, the lower surface of said I beam girders being continuous welded at least indirectly to said posts, one end of at least some roof panels overlying one side of the lower flange portion of a respective I beam girder and continuous welded thereto from both within and without said tank ensclosure.

* * * * *